US007263974B2

(12) United States Patent
Knight

(10) Patent No.: US 7,263,974 B2
(45) Date of Patent: Sep. 4, 2007

(54) FUEL INJECTION SYSTEMS

(75) Inventor: Andrew Knight, Stonehouse (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/411,630

(22) Filed: Apr. 26, 2006

(65) Prior Publication Data

US 2006/0243253 A1 Nov. 2, 2006

(30) Foreign Application Priority Data

Apr. 28, 2005 (EP) ..... 05252670

(51) Int. Cl.
*F02M 57/02* (2006.01)
*F02M 37/04* (2006.01)

(52) U.S. Cl. ..... 123/446; 123/506

(58) Field of Classification Search ..... 123/299, 123/300, 305, 456, 447, 446, 467, 506
See application file for complete search history.

(56) References Cited

U.S. PATENT DOCUMENTS 4,459,959 A * 7/1984 Terada et al. ..... 123/446
5,622,152 A * 4/1997 Ishida ..... 123/446
5,950,931 A * 9/1999 Beatty et al. ..... 239/533.8
6,491,017 B1 * 12/2002 Mahr et al. ..... 123/299
6,513,497 B1 * 2/2003 Mahr et al. ..... 123/447
6,619,263 B1 9/2003 Mahr et al.
6,688,277 B1 2/2004 Mahr et al.
6,776,138 B2 * 8/2004 Mahr et al. ..... 123/446
2004/0237930 A1 * 12/2004 Kawamura et al. ..... 123/299

FOREIGN PATENT DOCUMENTS

DE 4118237 12/1991
EP 1087130 3/2001
EP 1378659 1/2004
EP 1378660 1/2004

* cited by examiner

*Primary Examiner*—Mahmoud Gimie
(74) *Attorney, Agent, or Firm*—David P. Wood

(57) ABSTRACT

A fuel injection system for supplying pressurised fuel to a fuel injector (200) comprises an accumulator volume (606) for supplying fuel at rail pressure (P1) to the fuel injector (200) through a rail fuel supply passage (608) and a fuel pressurising arrangement (604) for supplying fuel at a selected pressure greater than rail pressure (P2) to the fuel injector (200) through a pressurised fuel supply passage (614). A fuel shut-off valve (618) is provided in the system which is operable between a closed position in which fuel is retained within the pressurising arrangement (604) and an open position in which pressurised fuel is supplied to the injector (200) from the pressurising arrangement (604) during an injection of fuel from the rail fuel supply passage (608). Operating the shut-off valve in this way provides a boost in the fuel pressure delivered during an injection event.

19 Claims, 10 Drawing Sheets

FUEL INJECTION SYSTEMS

FIELD OF THE INVENTION

The present invention concerns improvements relating to fuel injection systems for internal combustion engines and provides, more specifically, a fuel injection system which is capable of providing a range of injection pressure, or injection rate, characteristics for a given injector. The invention also relates to a control method for such a fuel injection system.

BACKGROUND TO THE INVENTION

Within current fuel injection systems a pump is used to deliver fuel to the engine cylinders via a high pressure supply line and, in the course of an 'injection', fuel enters a cylinder through one or more apertures which otherwise remain closed by seated injection needles. Typically, a vehicle travelling at around 30 miles per hour, say, will require tens of injections to be made into each of its engine cylinders per second.

Research has shown that, for a given injector, significant improvements in combustion quality and efficiency are achieved by rapidly varying the injection pressure, or injection rate, within an injection event. More particularly, commencing the event with a pilot injection at lower pressure and then following that with a main injection at higher pressure (as shown in the example injection profile of FIG. 1*a*), has highly beneficial effects on combustion emissions and noise. The benefits to emissions are still further improved if the main injection has a so-called 'boot-shaped' injection profile (an example of which is shown in FIG. 1*b*), whereby the main injection commences at a pilot pressure P1 but is then rapidly increased to a significantly higher pressure P2.

The timing of when fuel is supplied to an engine cylinder is determined by the movement of an injection valve needle of the associated injector. A known injector 200 is shown schematically in FIG. 2*a*. An electronically operated three-way needle control valve 202 is provided for controlling movement of an injector valve needle 204, relative to its seating 206, thereby to control the delivery of fuel from a fuel delivery chamber 207 to the engine cylinder (the engine cylinder is not shown in FIG. 2*a*). The needle control valve 202 is operable either to connect a high pressure (HP) supply line 208 and a control chamber 210 which houses the non-seating end of the valve needle 204, or to connect the control chamber 210 with a low pressure (LP) reservoir. The high pressure supply line 208 also supplies the fuel delivery chamber 207 which houses the seating end of the valve needle 204.

When the needle control valve 202 is in its 'closed' position (as shown in FIG. 2*a*), the control chamber 210 communicates with the high pressure supply line 208 such that it floods with high pressure fuel. This fuel, together with a spring 212 located in the control chamber 210, serves to urge the valve needle 204 against its seating 206 so that no fuel enters the cylinder. In contrast, when the needle control valve 202 is 'open' (as shown in FIG. 2*b*), communication between the control chamber 210 and the high pressure supply line 208 ceases and the control chamber 210 communicates instead with the low pressure reservoir. The valve needle 204 experiences so-called thrust forces arising from the high pressure fuel surrounding it (as shown in FIG. 3 prior to the needle 204 lifting). As pressure within the control chamber 210 reduces, these thrust forces become sufficient to overcome the force of the control chamber spring 212 and the valve needle 204 lifts from its seating 206, whilst the injector 200 continues to be supplied by the high pressure supply line 208. Accordingly, fuel is injected into the engine cylinder, through the revealed apertures, during an injection.

With regard to the desired boot injection profile, one way of increasing the pressure, or rate, at which fuel is injected for a given injector 200 is to use a pumping arrangement. Prior to engagement of the pumping action, a control valve is used to close communication with the high pressure fuel supply line 208. A known fuel injection system 400 of this type, devised by the present applicant and described in WO 03/093671, will now briefly be described with reference to FIG. 4.

The fuel injection system 400 is comprised of a high pressure fuel supply means 402 including a fuel pump 408 and an accumulator volume 410 which stores fuel at a moderately high and injectable pressure (for example, 300 bar). The accumulator volume 410 is more commonly referred to as a 'common rail'. The high pressure fuel supply means 402 supplies fuel to a pumping arrangement 404 and the fuel injector 200 of the system, as described above, via a high pressure supply line 208. In between the high pressure fuel supply 402 and the pumping arrangement 404, the high pressure supply line 208 is provided with a supply control valve 406. The supply control valve 406 and fuel injector 200 are both electronically operable and are controlled by an associated electronic engine controller (not shown) which controls operation of the supply control valve 406 and the action of the pumping arrangement 404 during injections.

The pumping arrangement 404 and the fuel injector 200 are arranged within a common unit, forming a so-called electronic unit injector (EUI). An engine is typically provided with a plurality of EUIs, one for each cylinder. The pumping arrangement 404 is comprised of a pumping chamber 414 and an associated spring-loaded plunger 416 which is operated by a driven cam 418, such that the plunger 416 is driven back and forth within the pumping chamber 414 whilst the engine is operating. The driven cam 418 has a lobed profile, comprising rising and trailing flanks. When engaged with the rising flank, the plunger 416 is driven into the pumping chamber 414 in a pumping stroke and then recedes, when engaged with the falling flank, during a return stroke. In between strokes, during the remainder of the cam cycle, the plunger 416 is engaged by the substantially cylindrical body portion of the cam and remains substantially retracted with respect to the pumping chamber 414. When not injecting, the rail control valve 406 is kept in its 'open' position and the movement of the plunger 416 has substantially no effect on the pressure of fuel delivered via the high pressure supply line 208.

Details of how the fuel injection system 400 can be used to generate injection events having boot-shaped profiles will now be described. The electronic engine controller commences an injection event by moving the needle control valve 202 into its open position whilst also keeping the rail control valve 406 open. The needle control valve 202 is quickly returned to its closed position, such that the pilot part of the injection profile is achieved. After a short pause, the electronic engine controller reopens the needle control valve 202 to commence the main injection. Once the 'toe' part of the main injection profile is established at rail pressure, the electronic engine controller closes the rail control valve 406 to effect the second part of the boot profile, this action coinciding with a pump stroke by the plunger 416 when it is engaged with the rising flank of the driven cam 418.

Whilst the rail control valve 406 remains closed, the operation of the pumping arrangement 404 serves to increase the pressure of the fuel contained within the electronic unit injector by decreasing the volume in which the fuel is contained, giving rise to a peak boot pressure. The electronic engine controller ends the main injection, and hence the injection event, at or before the conclusion of the pumping stroke by returning the needle control valve 202 to its closed position and reopening the rail control valve 406. Alternatively, the main injection may be terminated by reopening the rail control valve 406, followed by the needle control valve 202 being returned to its closed position.

FIG. 5 shows a variety of main injection profile results 500 obtained using the fuel injection system 400 for an injection event of fixed duration. Of these profiles, the maximum injection pressure is shown by the 'square' profile 502. Prior to injecting, the rail control valve 406 has been closed for a substantial part of a pumping stroke of the plunger 416, such that when the needle control valve 202 is moved into its open position the fuel within the electronic unit injector has undergone the maximum compression available within the fuel injection system 400. In contrast, the profile 504 closest in character to the desired boot profile, which is obtained as explained above, achieves the lowest peak pressure of the profiles shown. This is because the injection event initially proceeds with the rail control valve 406 open, leaving less time (in an injection event of fixed quantity) for a build-up of pressure to be achieved under the action of the plunger 416.

In order to optimise emissions from an engine operating under a particular load condition, it is desirable to have a fuel injection system that can readily implement variations to the injection profile. Accordingly, one can then vary the constituent parts of the profile and measure the effects on the emissions. However, it is thought that the benefits on emissions arising from a boot injection profile are only realised when the peak pressure is sufficiently high. In addition, any injection profile is subject to certain practical constraints, namely a minimum volume of fuel must be delivered within a particular time frame that coincides with the cam cycle. Whilst the fuel injection system 400 has great advantages for allowing boot shaped injections to be realised, in some circumstances the system does not facilitate variations on an optimum scale.

It is therefore an object of the present invention to provide an improved injection system to address the issues mentioned above. More specifically, it is desired to provide a fuel injection system which allows greater control over the profile characteristics of an injection event, whilst allowing a sufficient quantity of fuel to be injected.

SUMMARY OF THE INVENTION

According to a first aspect of the present invention, a fuel injection system for supplying pressurised fuel to a fuel injector includes an accumulator volume for supplying fuel at rail pressure to the fuel injector through a rail fuel supply passage and a fuel pressurising arrangement, or pressure boosting arrangement, for supplying fuel at a selected pressure greater than rail pressure to the fuel injector through a pressurised fuel supply passage. A fuel shut-off valve is operable during an injection of fuel from the rail fuel supply passage between a closed position in which fuel is retained within the pressurising arrangement and an open position in which pressurised fuel is supplied to the injector from the pressurising arrangement, thereby to provide a boost in the fuel pressure delivered during an injection event.

As the fuel shut-off valve can be held shut at the same time as injection from the rail fuel supply passage occurs, pressure build up in the pressurising arrangement can occur during an initial portion of the injection event at rail pressure. When the fuel shut-off valve is subsequently opened, fuel within the pressurising arrangement, which has already reached the selected pressure greater than rail pressure, completes the injection event at the higher pressure level. It is a particular benefit of the fuel shut-off valve that a higher peak injection pressure is achievable for a boot-shaped injection event (an injection event having a lower initial injection pressure immediately followed by a higher injection pressure level). The invention therefore facilities a greater variety of injection characteristics to be achieved, providing particular benefits for emission levels.

In a preferred embodiment, the rail fuel supply passage and the pressurised fuel supply passage communicate with a delivery chamber of the injector. Depending on whether the pressurised fuel supply passage is opened by the shut off valve determines whether fuel is supplied to the injector delivery chamber at rail pressure or a boosted pressure.

In a further preferred embodiment, the rail fuel supply passage includes a non-return valve which serves to prevent a back flow of fuel at the selected pressure greater than rail pressure to the accumulator volume.

The system may further comprise a rail control valve which is operable between an open position in which fuel from the accumulator volume is permitted to flow into the fuel pressurising arrangement and a closed position in which fuel in the fuel pressurising arrangement is isolated from the fuel within the accumulator volume.

In one embodiment, the rail fuel supply passage includes a rail supply junction via which fuel within the accumulator volume is supplied to the fuel pressurising arrangement.

In an alternative embodiment, separate lines may define a feed passage for the pressurising arrangement and the rail fuel supply passage, with the rail control valve being located within the feed passage between the accumulator volume and the pressurising arrangement.

It is preferable for the rail control valve to be located between the rail supply junction and the fuel pressurising arrangement.

In a further preferred embodiment, the system may include a control arrangement for opening the rail control valve and closing the fuel shut-off valve prior to commencement of a main fuel injection event to enable the main fuel injection event at rail pressure via the rail fuel supply passage only and to enable communication between the accumulator volume and the fuel pressurising arrangement. The control arrangement is preferably configured to close the rail control valve after commencement of the main injection event to permit the pressure of the fuel isolated in the pressure boosting arrangement to increase, and open the fuel shut-off valve before the end of the main injection event to provide an injection of pressurised fuel through the pressurised fuel supply passage.

Preferably, the control arrangement is an electronic engine controller.

In a further preferred embodiment, the electronic engine controller is programmed to close the rail control valve and open the fuel shut-off valve at a pre-selected interval to control the injection profile of the injection event.

The electronic engine controller is preferably programmed to open the fuel shut-off valve after the fuel pressurising arrangement has pressurised the fuel to a peak pressure.

Preferably, the fuel pressurising arrangement includes a pumping chamber and pressurising means for increasing the pressure of fuel in the pumping chamber.

The pressuring means may include a cam and a plunger, whereby the plunger is driven back and forth within the pumping chamber upon rotation of the cam. The cam may be a so-called stepped retraction cam.

In one preferred embodiment the plunger and the injector may be formed in a single unit, such as in a so-called unit injector arrangement.

Preferably, the fuel shut-off valve is controlled by means of a shut-off control valve for controlling hydraulic forces acting on the fuel shut-off valve. The shut-off control valve typically comprises an electronically controlled three-way shut-off valve.

The shut-off control valve may be connected in a first position with pressurised fuel from the fuel pressurising arrangement and in a second position with a low pressure reservoir, whereby when in the first position the pressurised fuel is in communication with a shut-off valve control member to prevent opening of the fuel shut-off valve and when in the second position the shut-off valve control member is switched to communicate with the low pressure reservoir to cause the fuel shut-off valve to open. A preferred embodiment provides the fuel shut-off valve with a shut-off valve control chamber at least partially surrounding the shut-off valve control member, whereby switching between the first position of the shut-off control valve, in which the shut-off valve control chamber receives pressurised fuel from the fuel pressurising arrangement, to the second position, in which the shut-off valve control chamber receives low pressure fuel from the low pressure reservoir, results in opening of the fuel shut-off valve.

In accordance with a second aspect of the invention, there is provided a method for supplying pressurised fuel to a fuel injector of a fuel injection system according to the first aspect of the invention, the method comprising the steps of controlling whether fuel is pressurised to the selected pressure under the control of a rail control valve and commencing an injection event by injecting fuel only from the rail supply passage at rail pressure. During the injection of fuel at rail pressure, the rail control valve is closed to allow fuel within the pressurising arrangement to be pressurised and, subsequently and during the injection event, the fuel shut-off valve is opened so as to increase the pressure of the injected fuel to the selected pressure level.

The method may be adapted for use in a fuel injection system incorporating any of the preferred or optional features of the first aspect of the invention.

BRIEF DESCRIPTION OF THE DRAWINGS

Methods and apparatus according to a preferred embodiment of the fuel injection system invention will now be described by way of example, with reference to the accompanying drawings in which.

DETAILED DESCRIPTION OF A PREFERRED EMBODIMENTS OF THE PRESENT INVENTION

Figure 6:
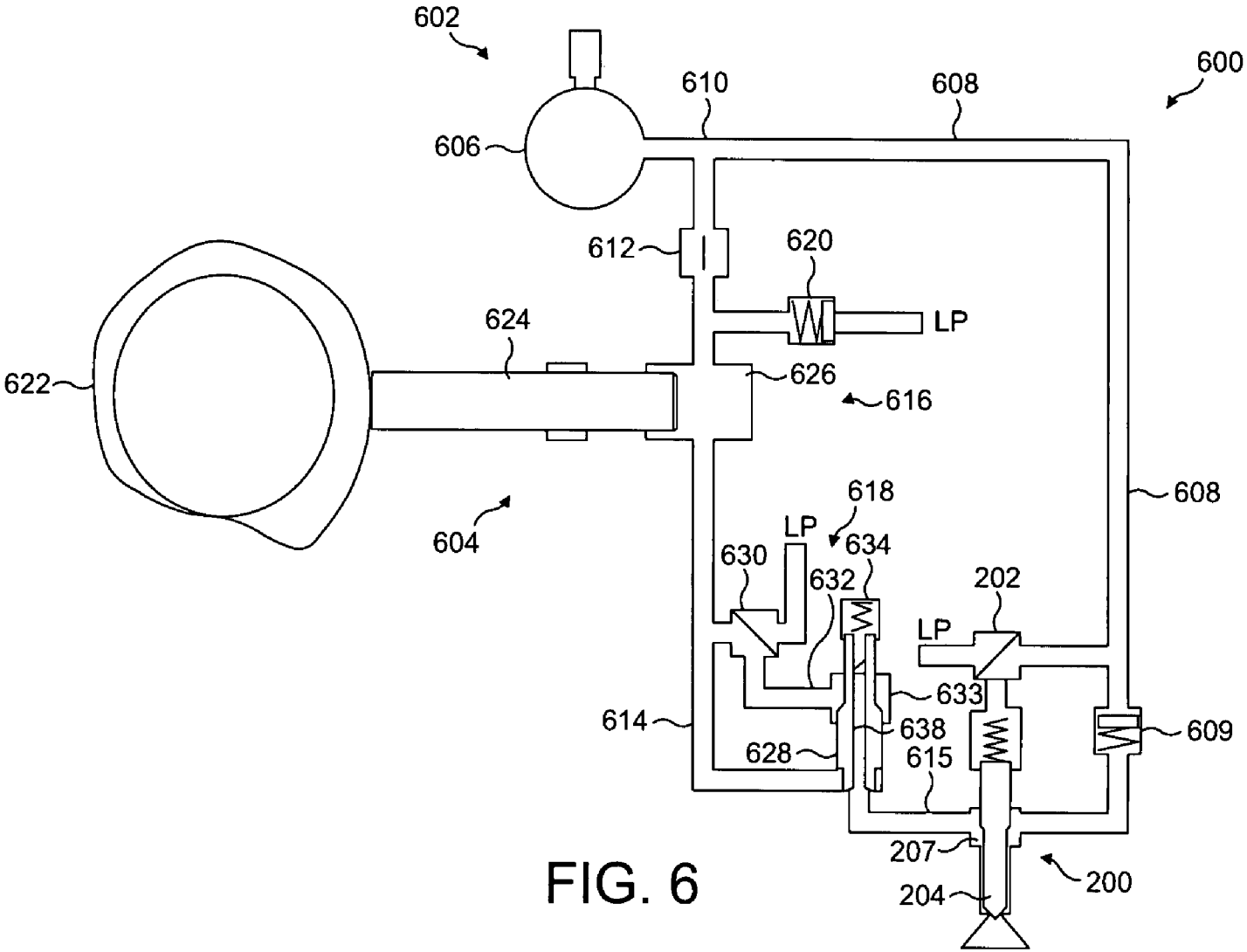
FIG. 6 is a schematic diagram of a fuel injection system according to an embodiment of the present invention when in a first operating state.

With reference to FIG. 6, a booster fuel injection system 600 for implementing a presently preferred embodiment of the present invention is now described. The booster fuel injection system 600 facilitates fuel injections which follow a boot injection profile by enabling an injection to commence at rail pressure whilst simultaneously boosting the pressure for the second part of the boot profile, such that a high peak pressure is achieved.

The booster fuel injection system 600 is comprised of a rail pressure fuel supply 602, a fuel pressurising arrangement (also referred to as a pressure boosting arrangement) 604 and the fuel injector 200 described previously. The rail pressure fuel supply 602 is comprised of an accumulator volume 606 and a rail pressure line 608 which communicates directly, via a first non-return valve 609, with the injector 200. The rail pressure fuel supply 602 of the booster fuel injection system 600 supplies the pressure boosting arrangement 604 with fuel via a rail supply junction 610 within the rail pressure line 608. A rail control valve 612 is located between the rail supply junction 610 and the pressure boosting arrangement 604. A high pressure supply line 614 also leads from the pressure boosting arrangement 604 to a connecting supply line 615 emerging from the delivery chamber 207 of the injector 200. The delivery chamber 207 can therefore communicate with either the rail pressure fuel supply 602 directly, or the pressure boosting arrangement 604, depending on the operating state of the system, as will be described in further detail later.

The pressure boosting arrangement 604 of the booster fuel injection system 600 will now be described in more detail. The rail control valve 612 communicates with a pumping arrangement 616 and the high pressure supply line 614, leading therefrom, is fitted with a high pressure valve arrangement 618 at its junction with the connecting supply line 615. In fact the high pressure supply line 614 and the connecting supply line 615 may be considered to form a common supply line, within which the high pressure valve arrangement 618 is located. The high pressure valve arrangement 618 determines whether fuel from the high pressure supply line 614 reaches the injector 200 and is the subject of the applicant's co-pending patent application WO 03/093671. In between the rail control valve 612 and the pumping arrangement 616 is a junction leading to a second non-return valve 620 that is in communication with a reservoir of fuel at low pressure; this remains closed except when the system 600 is being refilled, as will be described in due course.

The pumping arrangement 616 is comprised of a cam 622, a plunger 624 and a pumping chamber 626. The purpose of the pumping arrangement 616 is to increase, or 'boost', the pressure of fuel from the rail pressure fuel supply 602, depending on the position of the rail control valve 612. The preferred cam 622 for the booster fuel injection system 600 is what is referred to as a 'stepped retraction' or 'phased retraction' cam. A stepped retraction cam is the subject of the applicant's co-pending patent application WO 04/055359, and operates on the principle that plunger movement through the return stroke is interrupted to define steps which are phased to be synchronous with the pumping strokes of other ones of the plungers of the fuel injection system (i.e. the plungers associated with other ones of the injectors). As a result of using a phased retraction cam, negative torque loading of the camshaft is reduced. Alternatively, however, a conventional lobed cam, as utilised in the fuel injection system 400 of the prior art system, may equally be employed.

In practice, it is convenient to form the injector 200 and the pressure boosting arrangement 604 in a common unit, so as to provide a so-called unit injector arrangement.

The high pressure valve arrangement 618 includes a high pressure shut-off valve 628 and an electronically operated three-way shut-off control valve 630 for controlling the same. The shut-off control valve 630 receives its own feed from the high pressure supply line 614 and is operable between a first operating state (herein referred to as a 'closed' position) and a second operating state (herein referred to as an 'open' position). When the shut-off control valve 630 is in its closed position, the high pressure fuel line 614 delivers fuel, via a shut-off control supply line 632, to a shut-off valve control chamber 633 which partially surrounds the shut-off valve 628, thereby causing the shut-off valve 628 to close and preventing communication between the high pressure supply line 614 and the connecting supply line 615. In contrast, when the shut-off control valve 630 is in its open position, the shut-off control supply line 632 communicates with fuel from a low pressure reservoir associated with the control valve 630, thereby opening the shut-off valve 628 such that the high pressure supply line 614 and the connecting supply line 615 form a common supply line. Conveniently, the shut-off control valve 630 will be controlled by means of an electromagnetic actuator.

The shut-off valve 628 comprises a main valve body of substantially cylindrical form having a conical shoulder which rises to define an elongate neck. The lower part of the valve 628 consists of a substantially cylindrical region of narrower diameter than the main valve body. The upper part of the valve neck protrudes into a spring chamber 634 housing a spring which acts on the uppermost surface of the neck. The lower part of the valve neck and the valve shoulder are located within the shut-off valve control chamber 633 to which the shut-off control supply line 632 is connected. Internally, the shut-off valve 628 defines a substantially uniform bore 638 which runs axially through the centre of the valve before opening, at the base of the lower region of the valve, to communicate with the connecting supply line 615 to the injector 200.

The shut-off valve 628 is operable to control whether the high pressure supply line 614 communicates with the connecting supply line 615 (the open position of the shut off valve) or whether communication between the high pressure supply line 614 and the connecting supply line 615 is prevented (the closed position of the shut off valve). The bore 638 of the shut-off valve 628 is always in communication with the connecting supply line 615, regardless of whether the valve 628 is open or closed. When the valve 628 is open, the high pressure supply line 614 communicates with both the connecting supply line 615 and the bore 638 through the shut off valve 628.

The uppermost surface of the valve neck is subjected to the forces due to the spring and fuel pressure within the spring chamber 634, both of which serve to urge the shut off valve 628 into the closed position. The valve shoulder is subjected to the force due to fuel pressure within the shut-off valve control chamber 633 and, again, this forces serves to urge the shut off valve 628 into the closed position. The lower face of main valve body is subjected to the force due to fuel pressure within the high pressure supply line 614, and this force serves to oppose the valve closing forces described above. Finally, the lower face of the lower region of the valve is subjected to a force due to fuel pressure within the connecting supply line 615.

It is the shut-off control valve 630 that determines the position of the shut-off valve 628 and it does this by managing the forces acting on the various surfaces of the valve 628. To close the shut-off valve 628, the shut-off control valve 630 is moved into its closed position. This action blocks communication between the high pressure supply line 614 and the injector 200, with the result that the valve's bore 638 and the spring chamber 634 contain fuel at rail pressure due to the flow of fuel through the rail pressure line 608.

When the shut-off control valve 630 is moved into its open position, the pressure of fuel within the shut-off valve control chamber 633 is decreased and the imbalance of forces on the shut-off valve 628 causes it to open (i.e. lifted). As the valve 628 is caused to open, communication between the high pressure line 614 and the connecting supply line 615 of the injector 200 is enabled. Accordingly, if the high pressure supply line 614 contains fuel at higher pressure than rail pressure, then the higher pressure fuel floods into the bore 638, spring chamber 634 and fuel delivery chamber 207, 'boosting' the pressure of the fuel therein. The first non-return valve 609, located between the fuel delivery chamber 207 and the needle control valve 202, ensures that there is no back flow of higher pressure fuel, delivered to the injector 200 by the pressurising arrangement 604, to the rail pressure fuel supply 602. The higher pressure fuel thus has a 'real' effect in the injector 200 and is not merely dissipated to the rail pressure fuel supply 602.

As with the prior art fuel injection system 400, the needle control valve 202, the rail control valve 612 and the shut-off control valve 630 are all electronically operable under the control of a control means in the form of an electronic engine controller (not shown in the diagrams). The sequence of events governed by the electronic engine controller that leads to a fuel injection having a boot-shaped profile, preceded by a pilot injection of fuel, will now be described with respect to FIGS. 7*a* to 7*f*.

Figure 7A:
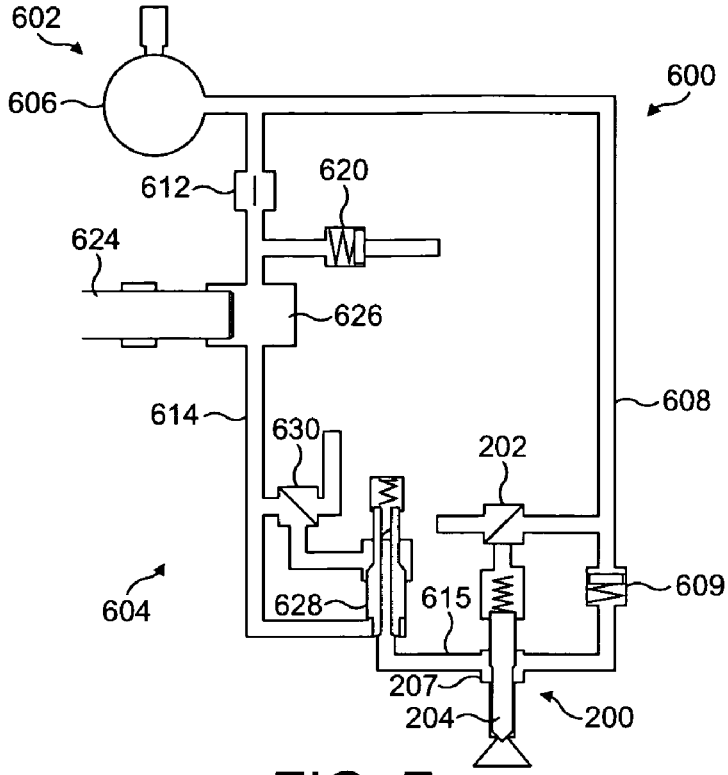
FIG. 7*a* to 7*e* are schematic diagrams of the fuel injection system of FIG. 6 when operating in a series of six different operating states, respectively, commencing with the operating state of FIG. 6.

FIG. 7*a* shows the booster fuel injection system 600 in its initial non-injecting state. The valve needle 204 remains seated since the needle control valve 202 is in its closed position, whilst the pressure boosting arrangement 604 is not operating to boost pressure as the rail control valve 612 is open. In addition, the shut-off control valve 630 is in its closed position and therefore the delivery chamber 207 of the injector 200 does not receive fuel from the high pressure supply line 614 via the shut off control valve 630, but only via the rail pressure line 608 directly.

Figure 7B:
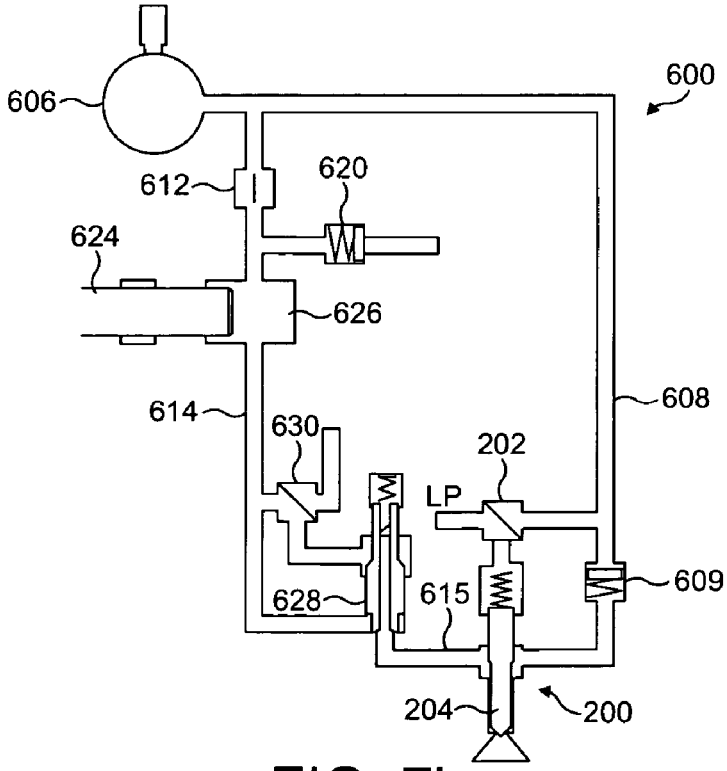

In FIG. 7*b*, the booster fuel injection system 600 is in an operating state in which fuel at rail pressure is injected into the engine to achieve a pilot injection of fuel, preceding the main injection of fuel. The components of the booster fuel injection system 600 remain configured in the same way as for FIG. 7*a* except for the valve needle 204, which has lifted since the needle control valve 202 (under the instruction of the electronic engine controller) is now in its open position. In such circumstances, fuel is injected at rail pressure. Accordingly, after a short duration of time has elapsed, the electronic engine controller instructs the needle control valve 202 to close, thereby moving the needle control valve 202 back to its closed position to seat the valve needle 204 (as in FIG. 7*a*) and terminate the pilot injection of fuel.

Figure 7C:
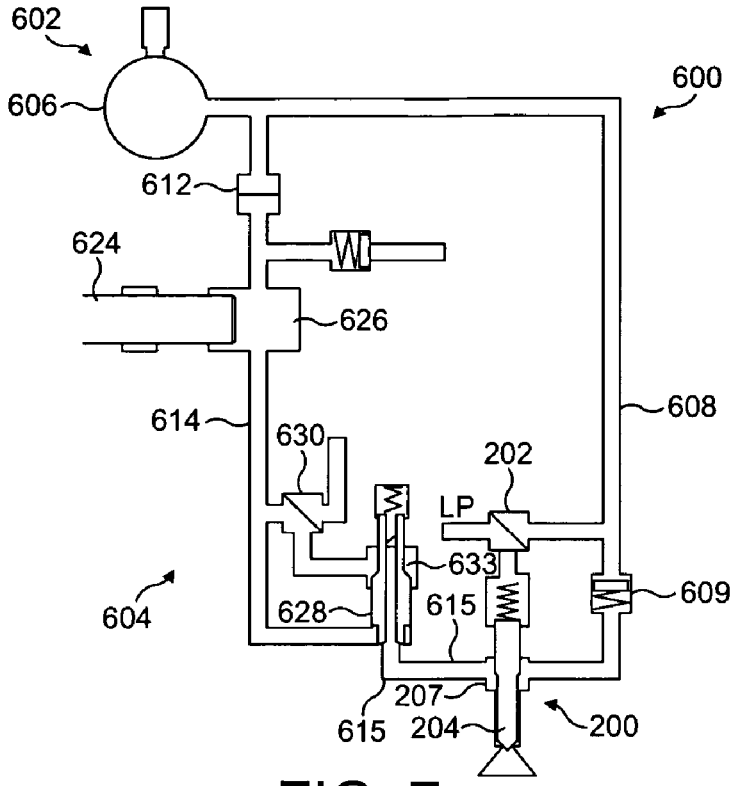

The toe part of the main injection event is then established by repeating the above steps. However, instead of curtailing the injection after the steps of FIG. 7*b*, the electronic engine controller is configured to initiate the pressure boosting phase, as shown in FIG. 7*c*. Here, the valve needle 204 remains lifted, during which period the electronic engine controller closes the rail control valve 612 during a pumping stroke of the plunger 624 (alternatively, the rail control valve 612 can be closed earlier during the pilot injection of fuel to start the pressurisation for the main injection earlier in the cycle). Accordingly, with the shut-off control valve 630 still in its closed position, the shut-off valve 628 blocks communication between the pressure boosting arrangement 604 and the connecting supply line 615. Fuel is therefore trapped or retained within the pressure boosting arrangement 604 and is compressed under the action of the plunger 624 as it continues its pumping stroke. In this way, the injection proceeds at rail pressure whilst a store of high pressure fuel is created simultaneously within the pressure boosting arrangement 604.

Figure 7D:
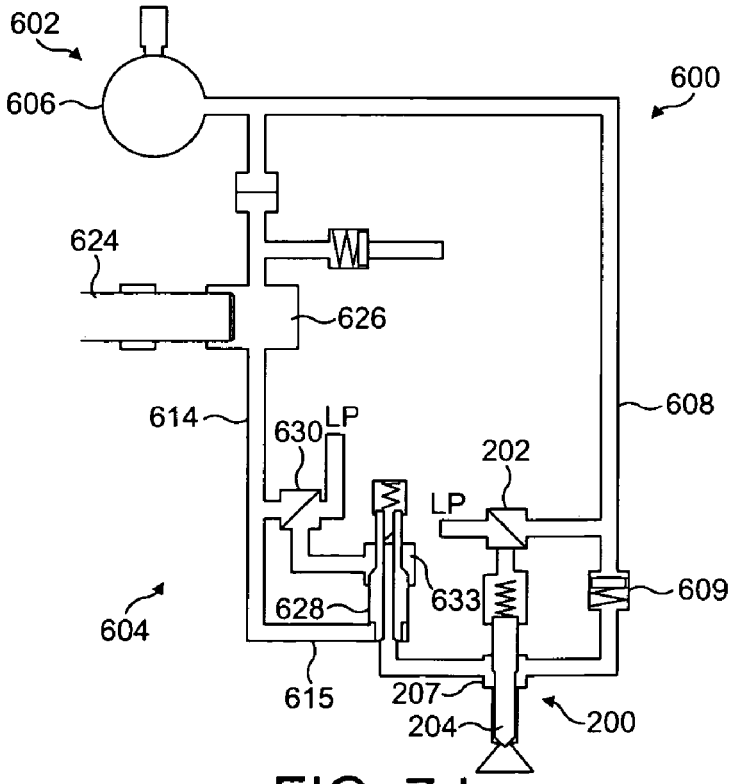

At some stage prior to the end of the pumping stroke, the electronic engine controller causes the pressure boosting arrangement 604 to release its store of high pressure fuel by moving the shut-off control valve 630 to its open position, as shown in FIG. 7*d*. This action results with the shut-off valve 628 opening, so that the high pressure fuel from the pressure boosting arrangement 604 floods through the shut-off valve 628, from the high pressure supply line 614 to the connecting supply line 615 and into the delivery chamber 207. Fuel injection, which was previously taking place at rail pressure, receives a sudden and intense boost in pressure. Accordingly, the second part of the boot profile of the main injection event is established, with the pressure of injected fuel being independent of the characteristics of the toe part of the injection.

Figure 7E:
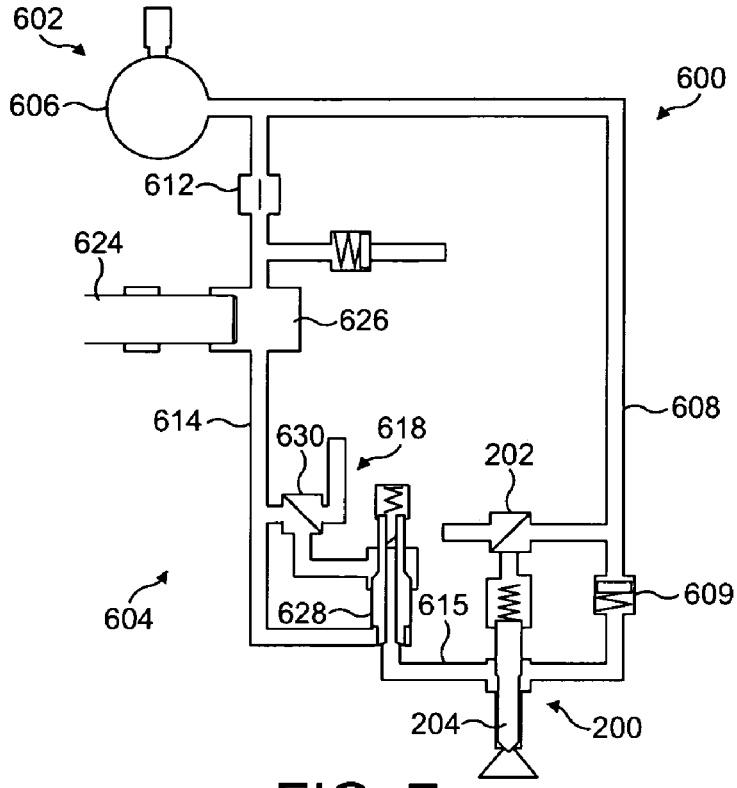

Prior to or at the end of the pumping stroke, when the main injection event is to be terminated, the electronic engine controller returns the booster fuel injection system 600 to its initial state by moving the needle control valve 202 and the shut-off control valve 630 back to their respective closed positions and opening the rail control valve 612. Hence, the resulting configuration, as shown in FIG. 7*e*, is identical to that of FIG. 7*a*, with the valve needle 204 being seated once again. Subtle changes in the injection termination characteristics may be achieved by controlling the respective timings of opening and closing of the valves 630, 612 and 202.

Figure 7F:
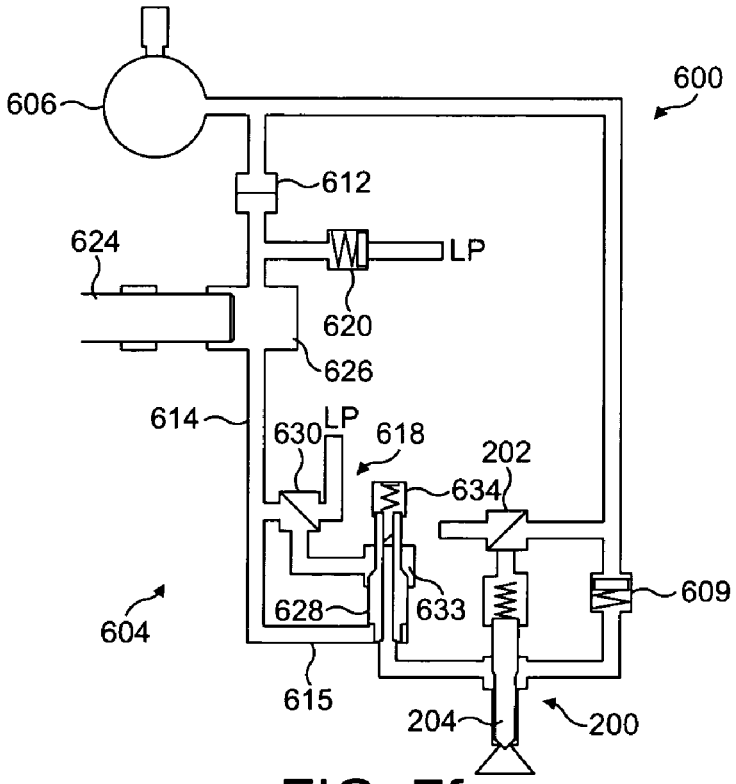

Finally, FIG. 7*f* shows the configuration of the booster fuel injection system 600 when the pressure boosting arrangement 604 is refilled. Unlike the fuel supply 402 of the prior art system, the accumulator volume 606 is not replenished by a direct external feed. Instead, at the end of each injection, fuel is replenished from the low pressure fuel reservoir via the second non-return valve 620. Prior to, or during, the plunger 624 commencing its return stroke, the electronic engine controller closes the rail control valve 612 and moves the shut-off control valve 630 to its closed position in order to create a closed system. The needle control valve 202 is also closed at this time. As the plunger 624 retracts from the pumping chamber 626, the volume of the closed system increases and the pressure drops accordingly. The shut-off valve 628 remains closed due to the pressure exerted on it by the spring within the spring chamber 634. Low pressure fuel is drawn through the second non-return valve 620 into the pressure boosting arrangement 604, as the internal fuel pressure is below that of the low pressure fuel reservoir. The electronic engine controller then reopens the rail control valve 612 prior to the plunger 624 commencing its next pumping stroke. As the plunger 624 performs a pumping stroke, fuel pressure within the pumping chamber 626 is increased, causing the accumulator volume 606 to be filled with high pressure fuel so that the system is returned to its initial state as shown in FIG. 7*a*.

If necessary, an injection of fuel can occur during the filling process by opening the needle control valve 202. The system therefore provides the further advantage that injection can be effected during any stage of the full cycle.

Figure 1A:
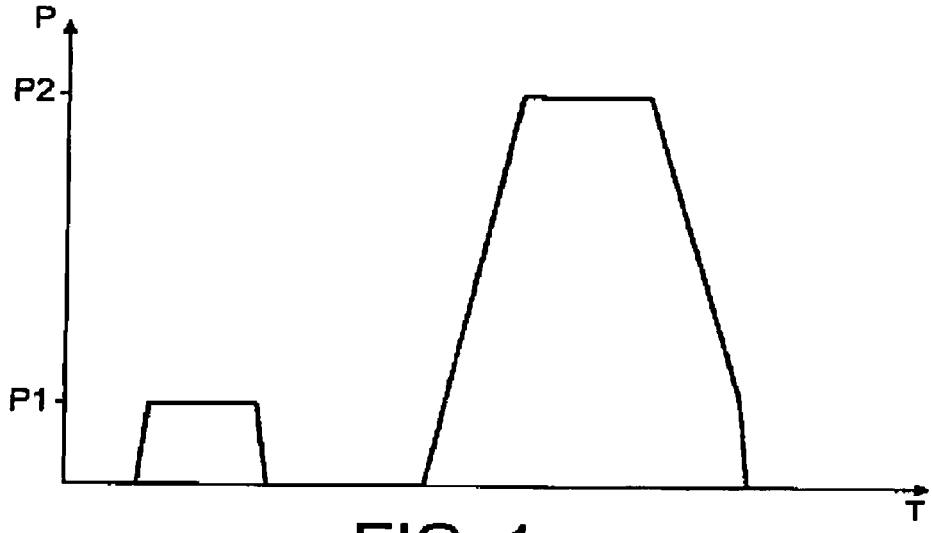
FIG. 1a PRIOR ART
FIGS. 1*a* and 1*b* are graphs showing examples of idealised fuel injection profiles which are beneficial for combustion engine emissions.
Figure 1B:
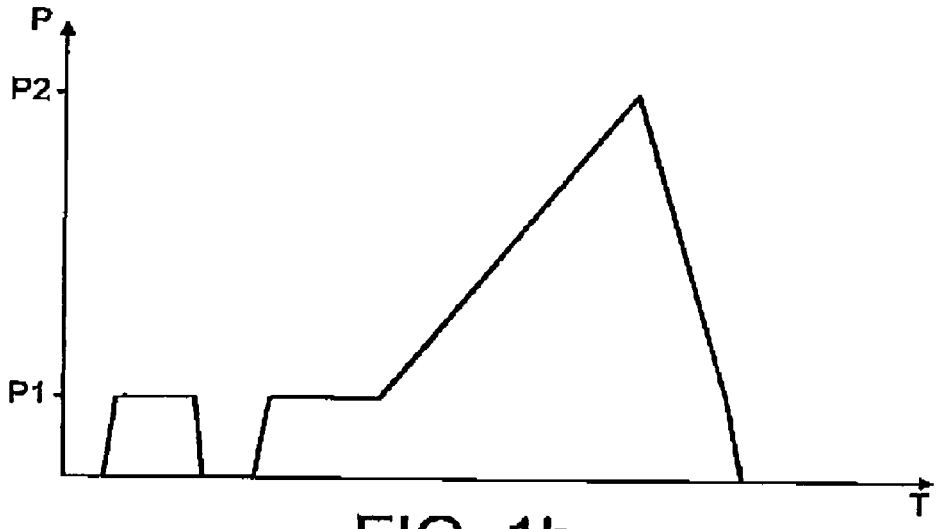
FIG. 1b PRIOR ART
Figure 2A:
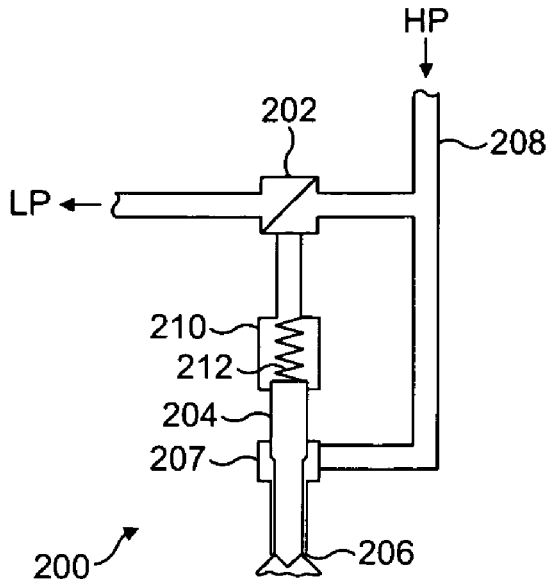
FIG. 2a PRIOR ART
FIGS. 2*a* and 2*b* are schematic diagrams showing a known fuel injector in seated and lifted operating states, respectively.
Figure 2B:
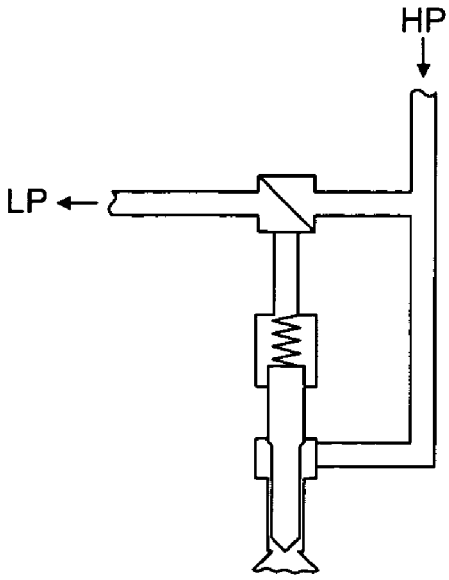
FIG. 2b PRIOR ART
Figure 3:
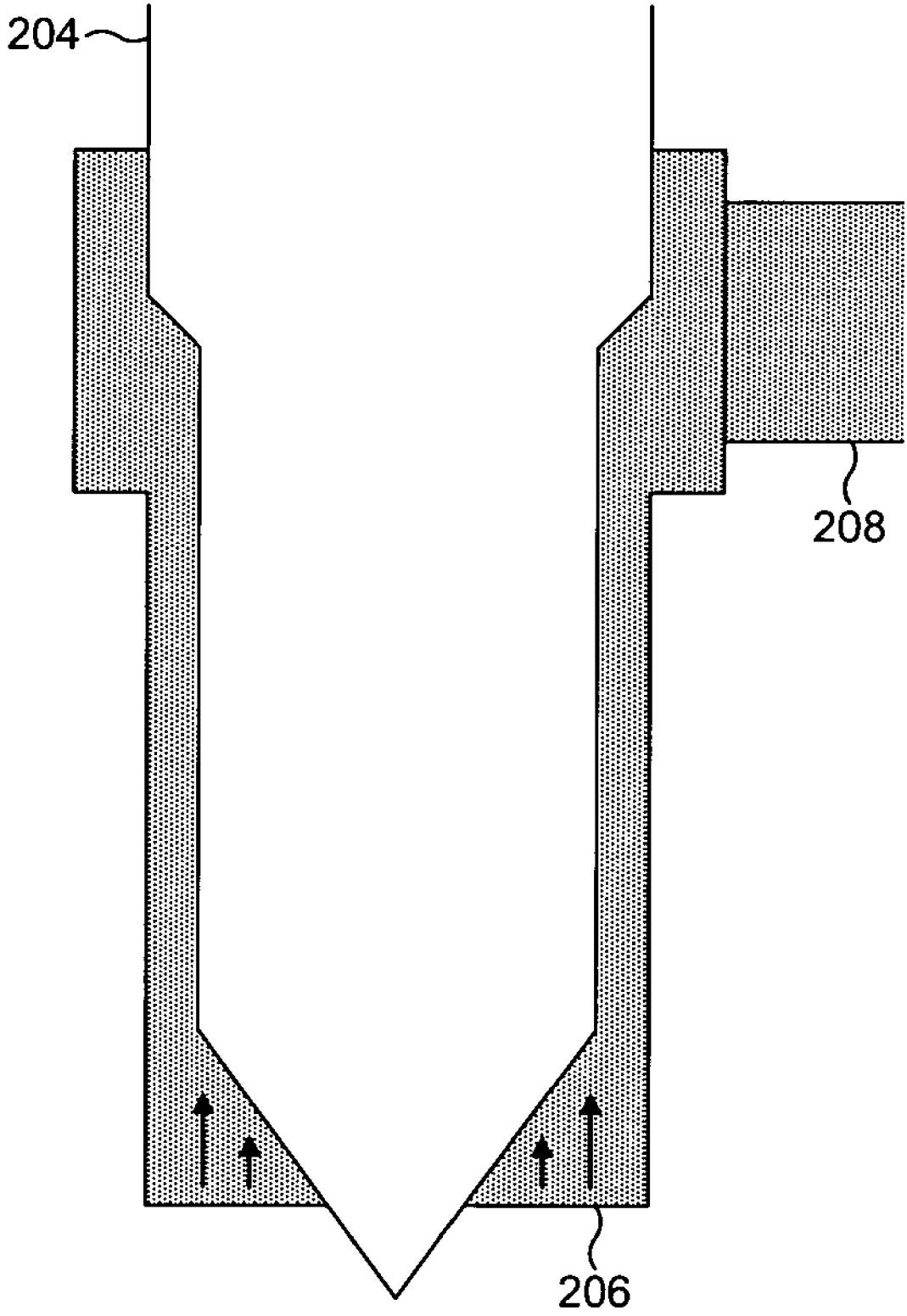
FIG. 3 is a schematic diagram showing the lifting forces which act on a valve needle of the fuel injector of FIGS. 2*a* and 2*b;*
Figure 4:
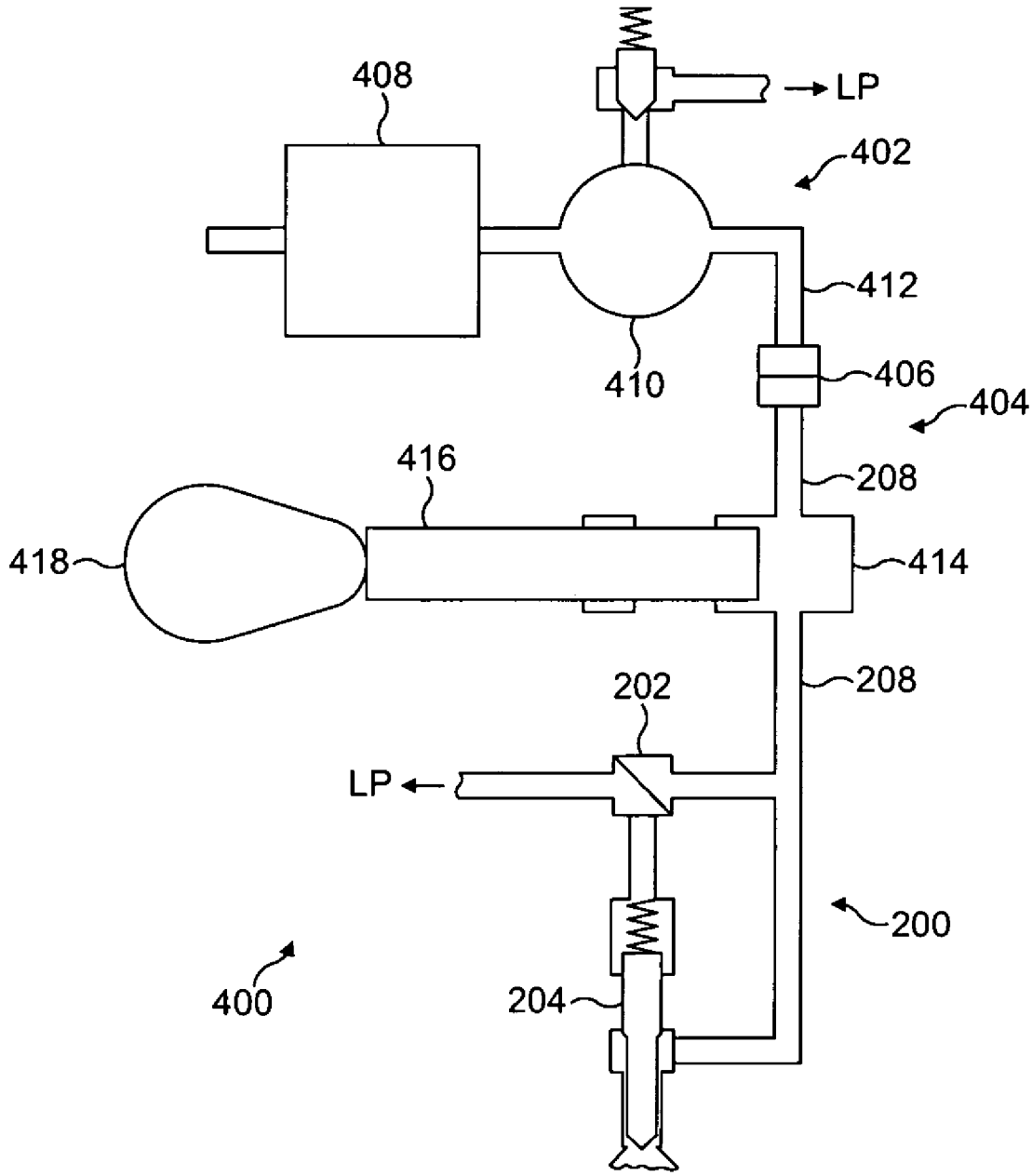
FIG. 4 PRIOR ART
FIG. 4 is a schematic diagram of a known fuel injection system employing the fuel injector of FIGS. 2*a* and 2*b;*
Figure 5:
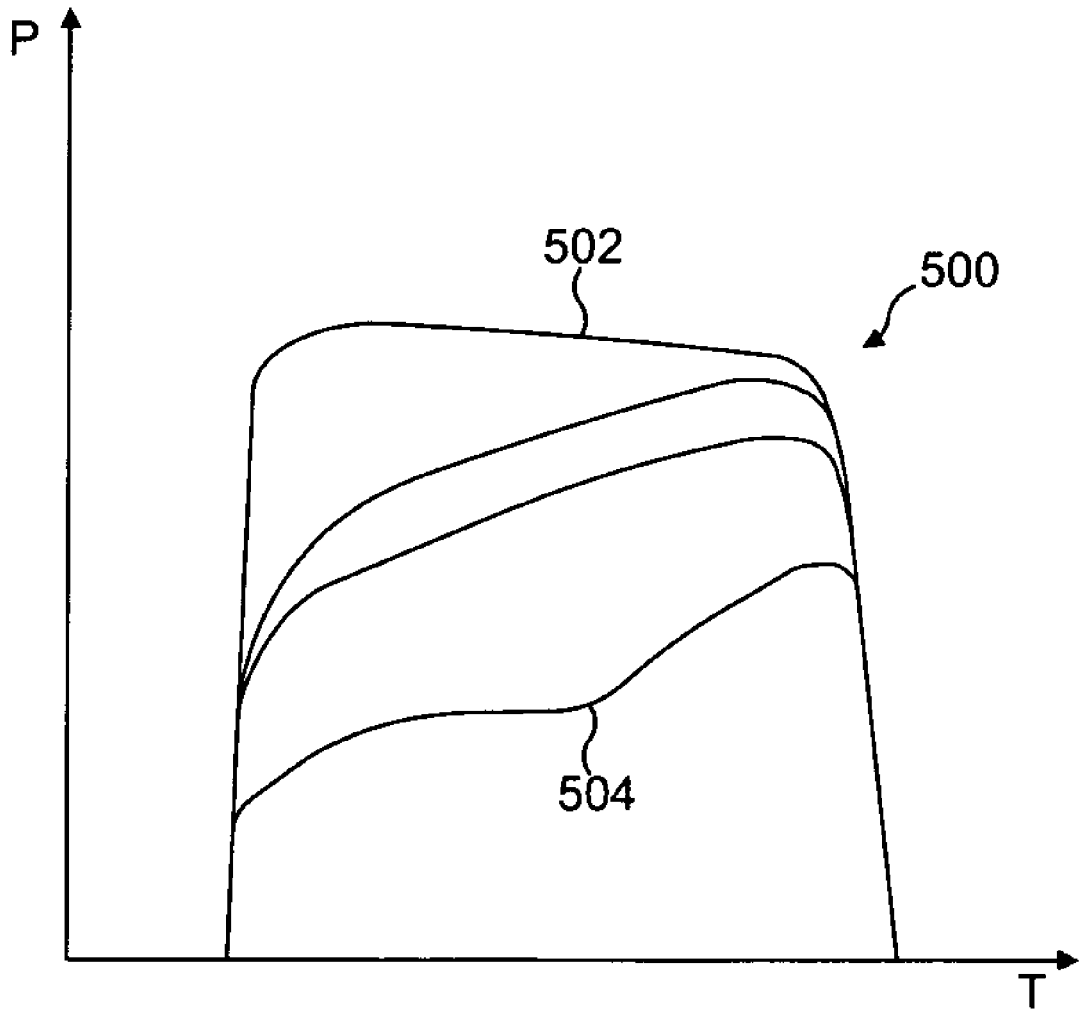
FIG. 5 is a graph showing fuel injection profiles obtained using the fuel injection system of FIG. 4.
Figure 8:
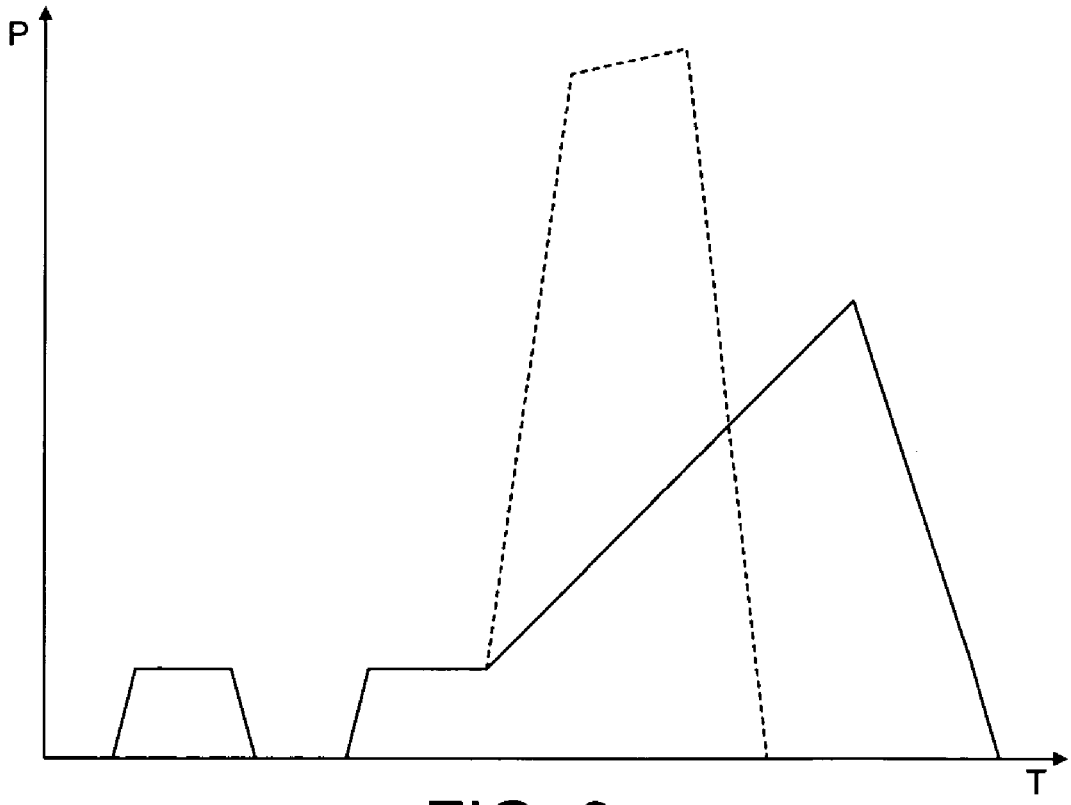
FIG. 8 is a graph contrasting the idealised fuel injection profile of FIG. 1*b* with an idealised fuel injection profile which is appropriate for the fuel injection system of FIG. 6.

An example of an idealised injection boot profile appropriate for the booster fuel injection system 600 is shown in FIG. 8 (see dotted line), where it is contrasted with the example from FIG. 1*b* for the prior art fuel injection system 400 (see solid line).

It will be appreciated that for main injections commencing with an identical toe section, the second parts of the injection profile achievable by the two contrasting fuel injection systems are radically different. The booster fuel injection system 600 allows greater peak injection pressures to be achieved than in the fuel injection system 400. Furthermore, these peaks can be achieved more rapidly by the booster fuel injection system 600. In turn this means that, for a given injector, fuel is injected at a greater rate and so injection events can be completed more quickly. It is a further benefit that synchronicity between the injector and the engine is improved, such that the timing of the injection can be targeted to coincide with optimum conditions within the engine. In summary, the booster fuel injection system 600 facilitates greater variation of injection profile characteristics which will aid minimising engine emissions.

Having described a particular preferred embodiment of the present invention, it is to be appreciated that the embodiment in question is exemplary only, and that variations and modifications, such as those that will occur to those possessed of the appropriate knowledge and skills, may be made without departure from the scope of the invention as set forth in the appended claims. For example, it will be appreciated that it need not be a surface of the valve needle 204 itself that is exposed to fuel pressure within the control chamber 210, rather it could be an associated surface, for example an extension piece of the valve needle 204. Additionally, the control chamber 210, and hence the valve needle spring 212, may be located remotely from the valve needle 204 itself, whilst still providing the required closing force to seat the valve needle 204 to terminate injection. A further design option is to locate the spring 212 elsewhere, and not within the control chamber 212. Further alternative variations in injector design will be apparent to those familiar with this technical field.

Of course, any of the valves described previously may preferably, but need not, be electrically or electromagnetically operated by energisation or de-energisation of an electromagnetic actuator winding. It will further be appreciated that references to "actuation of a valve" to cause a valve to move between its operating positions may, for an electromagnetically operable valve, be implemented either by increasing the energisation level of the actuator winding or by decreasing the energisation of the winding to cause said movement. Other forms of valve actuation means would, however, be envisaged by those skilled in the art, both hydraulic and/or mechanical, whilst still achieving the required valve functions.

It will also be apparent that the electronic engine controller will operate in accordance with look-up tables or data maps containing pre-stored information. The implementation of look-up tables and data maps for engine fuelling purposes would be familiar to a person skilled in this technical field.

With regard to the rail pressure fuel supply 602, it will be apparent to those skilled in the art that an accumulator volume which is supplied by an external feed could be employed. In this embodiment the system re-filling process described with respect to FIG. 7*f* is no longer required.

It will further be appreciated that the shut off valve 618 may be configured differently, whilst still enabling the advantages of the invention to be achieved, and that the specific structure of the shut off valve 618 described previously is only one example of a suitable valve construction that may be used. For example, the control surface of the shut of valve member 628, being the surface exposed to fuel within the chamber 633 in the embodiment described, may be arranged at one end of the shut off valve member 28 instead.

The invention claimed is:

1. A fuel injection system for supplying pressurised fuel to a fuel injector, the fuel injection system comprising:

an accumulator volume for supplying fuel at rail pressure to the fuel injector through a rail fuel supply passage;

a fuel pressurising arrangement for supplying fuel at a selected pressure greater than rail pressure to the fuel injector through a pressurised fuel supply passage;

a rail control valve operable between a restricted-flow position in which the flow of fuel from the fuel pressurising arrangement to the accumulator is reduced relative to the flow rate at an open position in which fuel from the accumulator volume is permitted to flow more freely from the fuel pressurising arrangement to the accumulator; and a fuel shut-off valve operable during an injection of fuel from the rail fuel supply passage between a closed position in which fuel is retained within the pressurising arrangement and an open position in which pressurised fuel is supplied to the injector from the pressurising arrangement, thereby to provide a boost in the fuel pressure delivered during an injection event.

2. A system according to claim 1, wherein the rail fuel supply passage and the pressurised fuel supply passage communicate with a delivery chamber of the injector.

3. A system according to claim 1, wherein the rail fuel supply passage includes a non-return valve which serves to prevent a back flow of fuel at the selected pressure greater than rail pressure to the accumulator volume.

4. A system according to claim 1, wherein the fuel pressurising arrangement comprises a pumping chamber and a pressurising arrangement for increasing the pressure of fuel in the pumping chamber.

5. A system according to claim 4, wherein the pressuring arrangement comprises a cam and a plunger, whereby the plunger is driven back and forth within the pumping chamber upon rotation of the cam.

6. A system according to claim 5, wherein the cam is a stepped refraction cain.

7. A system according to claim 1, wherein the fuel shut-off valve is controlled by a shut-off control valve for controlling hydraulic forces acting on the fuel shut-off valve.

8. A system according to claim 7, wherein the shut-off control valve comprises an electronically controlled three-way valve.

9. A fuel injection system for supplying pressurised fuel to a fuel injector, the fuel injection system comprising:

an accumulator volume for supplying fuel at rail pressure to the fuel injector through a rail fuel supply passage;

a fuel pressurising arrangement for supplying fuel at a selected pressure greater than rail pressure to the fuel injector through a pressurised fuel supply passage;

a fuel shut-off valve operable during an injection of fuel from the rail fuel supply passage between a closed position in which fuel is retained within the pressurising arrangement and an open position in which pressurised fuel is supplied to the injector from the pressurising arrangement, thereby to provide a boost in the fuel pressure delivered during an injection event; and a rail control valve operable between an open position in which fuel from the accumulator volume is permitted to flow into the fuel pressurising arrangement and a closed position in which fuel in the fuel pressurising arrangement is isolated from the fuel within the accumulator volume.

10. A system according to claim 4, wherein the rail fuel supply passage includes a rail supply junction via which fuel within the accumulator volume is supplied to the fuel pressurising arrangement.

11. A system according to claim 10, wherein the rail control valve is located between the rail supply junction and the fuel pressurising arrangement.

12. A system according to claim 10, including a control arrangement adapted to:

open the rail control valve and close the fuel shut-off valve prior to commencement of a main fuel injection event to enable the main fuel injection event at rail pressure via the rail fuel supply passage only and to enable communication between the accumulator volume and the fuel pressurising arrangement, close the rail control valve after commencement of the main injection event to permit the pressure of the fuel isolated in the pressure boosting arrangement to increase, and open the fuel shut-off valve before the end of the main injection event to provide an injection of pressurised fuel through the pressurised fuel supply passage.

13. A system according to claim 12, wherein said control arrangement is an electronic engine controller.

14. A system according to claim 13, wherein the electronic engine controller is programmed to close the rail control valve and open the fuel shut-off valve at a preselected interval to control the injection profile of the injection event.

15. A system according to claim 14, wherein the electronic engine controller is programmed to open the fuel shut-off valve after the fuel pressurising arrangement has pressurised the fuel to a peak pressure.

16. A fuel injection system for supplying pressurised fuel to a fuel injector, the fuel injection system comprising:

an accumulator volume for supplying fuel at rail pressure to the fuel injector through a rail fuel supply passage;

a fuel pressurising arrangement for supplying fuel at a selected pressure greater than rail pressure to the fuel injector through a pressurised fuel supply passage; and a fuel shut-off valve operable during an injection of fuel from the rail fuel supply passage between a closed position in which fuel is retained within the pressurising arrangement and an open position in which pressurised fuel is supplied to the injector from the pressurising arrangement, thereby to provide a boost in the fuel pressure delivered during an injection event;

wherein the fuel shut-off valve is controlled by a shut-off control valve for controlling hydraulic forces acting on the fuel shut-off valve;

wherein the shut-off control valve comprises an electronically controlled three-way valve; and wherein the shut-off control valve is connected in a first position with pressurised fuel from the fuel pressurising arrangement and in a second position with a low pressure reservoir, whereby when in the first position the pressurised fuel is in communication with a shut-off valve control member to prevent opening of the fuel shut-off valve and when in the second position the shut-off valve control member is switched to communicate with the low pressure reservoir to cause the fuel shut-off valve to open.

17. A system according to claim 16, wherein the fuel shut-off valve comprises a shut-off valve control chamber at least partially surrounding the shut-off valve control member, whereby switching between the first position of the shut-off control valve, in which the shut-off valve control chamber receives pressurised fuel from the fuel pressurising arrangement, to the second position, in which the shut-off valve control chamber receives low pressure fuel from the low pressure reservoir, results in opening of the fuel shut-off valve.

18. A fuel injection system for supplying pressurised fuel to a fuel injector, the fuel injection system comprising:

an accumulator volume for supplying fuel at rail pressure to the fuel injector through a rail fuel supply passage;

a fuel pressurising arrangement for supplying fuel at a selected pressure greater than fuel pressure to the fuel injector through a pressurised fuel supply passage;

a rail supply junction via which fuel within the accumulator volume is supplied to the fuel pressurising arrangement;

a rail control valve located between the fuel supply junction and the fuel pressurising arrangement and being operable between an open position in which fuel from the accumulator volume is permitted to flow into the fuel pressurising arrangement far pressurisation, and a closed position in which fuel in the fuel pressurising arrangement is isolated from the fuel within the accumulator volume; and a fuel shut-off valve operable during an injection of fuel from the rail fuel supply passage between a closed position in which fuel is retained within the pressurising arrangement and an open position in which pressurised fuel is supplied to the injector from the pressurising arrangement, thereby to provide a boost in the fuel pressure delivered during an injection event.

19. A method for supplying pressurised fuel to a fuel injector of a fuel injection system, the method comprising:

providing an accumulator volume for supplying fuel at rail pressure to the fuel injector through a rail fuel supply passage;

providing a fuel pressurising arrangement for supplying fuel at a selected pressure greater than rail pressure to the fuel injector through a pressurised fuel supply passage;

providing a rail control valve operable between a restricted-flow position in which the flow of fuel from the fuel pressurising arrangement to the accumulator is reduced relative to the flow rate at an open position in which the fuel from the accumulator volume is permitted to flow more freely from the fuel pressurising arrangement to the accumulator; and providing a fuel shut-off valve operable during an injection of fuel from the rail fuel supply passage between a closed position in which fuel is retained within the pressurising arrangement and an open position in which pressurised fuel is supplied to the injector from the pressurising arrangement, thereby to provide a boost in the fuel pressure delivered during an injection event;

controlling whether fuel is pressurised to the selected pressure under the control of the rail control valve, commencing an injection event by injecting fuel only from the rail supply passage at rail pressure, during the injection of fuel at rail pressure, closing the rail control valve to allow fuel within the pressurising arrangement to be pressurised, and subsequently and during the injection event opening the fuel shut-off valve so as to increase the pressure of the injected fuel to the selected pressure level.

* * * * *